US008060949B2

(12) United States Patent
Carcaterra et al.

(10) Patent No.: US 8,060,949 B2
(45) Date of Patent: Nov. 22, 2011

(54) PROTECTIVE SPORTS GLOVE

(75) Inventors: Paul Carcaterra, Ridgefield, CT (US); John Gagliardi, Garden City, NY (US)

(73) Assignee: Maverik Lacrosse, LLC, Long Island City, NY (US)

( * ) Notice: Subject to any disclaimer, the term of this patent is extended or adjusted under 35 U.S.C. 154(b) by 995 days.

(21) Appl. No.: 11/905,897

(22) Filed: Oct. 5, 2007

(65) Prior Publication Data

US 2009/0019613 A1 Jan. 22, 2009

Related U.S. Application Data

(60) Provisional application No. 60/929,978, filed on Jul. 20, 2007.

(51) Int. Cl.
*A41D 19/00* (2006.01)

(52) U.S. Cl. ..... 2/161.6

(58) Field of Classification Search ..... 2/16, 20, 2/161.1, 161.6, 163
See application file for complete search history.

(56) References Cited

U.S. PATENT DOCUMENTS 3,605,117 A 9/1971 Latina
4,103,362 A 8/1978 Blakeman
4,484,359 A 11/1984 Tirinen
4,589,146 A 5/1986 Taylor
4,751,749 A 6/1988 Cowhey
4,768,234 A * 9/1988 Yamamoto ..... 2/16
4,815,147 A 3/1989 Gazzano
5,067,175 A * 11/1991 Gold ..... 2/16
5,237,703 A 8/1993 Brine
5,309,573 A 5/1994 Solar et al.
5,329,639 A 7/1994 Aoki
5,488,739 A 2/1996 Cardinel
5,581,809 A 12/1996 Mah
5,983,396 A * 11/1999 Morrow et al. ..... 2/161.1
6,085,354 A 7/2000 Wilder
6,122,769 A 9/2000 Wilder
D446,888 S 8/2001 Morrow
D462,146 S 8/2001 Aoki
6,543,057 B2 4/2003 Beland et al.
6,550,069 B1 * 4/2003 Morrow ..... 2/161.1
6,715,152 B2 * 4/2004 Mazzarolo ..... 2/161.6
6,813,780 B2 11/2004 Morrow
7,103,924 B2 9/2006 Morrow
7,117,540 B2 10/2006 Morrow
7,370,373 B2 * 5/2008 Kohler ..... 2/161.1
2003/0014805 A1 1/2003 Morrow
2003/0101504 A1 6/2003 Morrow
2003/0192104 A1 10/2003 Wilder
2004/0093656 A1 5/2004 Morrow
2005/0066412 A1 3/2005 Morrow
(Continued)

*Primary Examiner* — Katherine Moran
(74) *Attorney, Agent, or Firm* — Oblon, Spivak, McClelland, Maier & Neustadt, L.L.P.

(57) ABSTRACT

In accordance with at least one exemplary embodiment, a protective glove for lacrosse, hockey and like sports is disclosed. The protective glove can have a hand receiving portion that can include finger portions, a thumb portion, a metacarpal portion and a wrist portion. The hand receiving portion can have a dorsal side and a palm side. A plurality of protective elements that can include non-gel protective sections and at least one impact gel piece can be on the dorsal side of the hand receiving portion. A lower forearm portion can be attached to the hand receiving portion. An exemplary impact gel piece can be a polyurethane gel piece, which can be made substantially of polyurethane polymers and can be encapsulated. The exemplary impact gel piece can be disposed on at least a portion of one boundary between the thumb portion and metacarpal portion of an exemplary protective glove.

18 Claims, 4 Drawing Sheets

U.S. PATENT DOCUMENTS

| | | | | |
|---|---|---|---|---|
| 2005/0114984 | A1 | 6/2005 | Morrow | |
| 2005/0273905 | A1 | 12/2005 | Gait | |
| 2006/0206980 | A1 | 9/2006 | Hammons et al. | |
| 2006/0206981 | A1 | 9/2006 | Morrow | |
| 2007/0240247 | A1 * | 10/2007 | Beck | 2/16 |
| 2009/0113592 | A1 * | 5/2009 | Iwata et al. | 2/19 |

* cited by examiner

PROTECTIVE SPORTS GLOVE

CROSS REFERENCE TO RELATED APPLICATIONS

This application claims priority, under 35 U.S.C. §119(e), to U.S. Provisional Patent Application Ser. No. 60/929,978, filed Jul. 20, 2007, the disclosure of which is incorporated by reference herein in its entirety.

BACKGROUND

Protective sporting gloves have been used in lacrosse, hockey and other similar contact sports for a long time. The gloves are designed to protect a wearer of the gloves from impacts from equipment used within the game (e.g., lacrosse sticks, hockey sticks, balls, pucks, skates, etc.), impacts between participants (e.g., stick checks, body checks, etc.), impacts with the playing surface (falls, dives, knock-downs, etc.), impacts from objects on and around the playing surface (e.g., lacrosse goals, hockey goals, boards, etc.) and the like. Also, the gloves can offer protection against vibrations and other stresses to a wearer's hands.

Gloves are designed to provide substantial protection to the participant's fingers, hands, wrists and lower forearms while maintaining as much flexibility within the glove as possible. Flexibility is desired by the wearer so as to impart freedoms of movement to the fingers, hand, wrists and lower forearms needed to properly participate in the sport while protection is required to reduce injury to the same.

Often as background gloves have been designed to increase protection for a wearer, a reduction in flexibility has followed from design elements such as the placement, size and configuration of protective elements as well as the materials chosen. Any reduction in flexibility can substantially reduce the effectiveness and level of play of a participant wearing such gloves. Conversely, often gloves designed to increase flexibility do so at the expense of protection and expose a wearer to a greater risk of injury. Breathability is another factor to take into account during glove design as excess perspiration and moisture can also affect a participant's performance.

There are several areas of the hand that need to maintain an increased level of flexibility and yet still need a high level of protection at the moment of impact. For example, these areas include dorsal portions of the fingers, the thumb, the hand and the wrist.

SUMMARY

According to at least one exemplary embodiment, a protective glove can have a hand receiving portion that can include a plurality of finger portions, a thumb portion, a metacarpal portion and a wrist portion. The hand receiving portion can have a dorsal side and a palm side. A plurality of protective elements that can include non-gel protective sections and at least one impact gel piece can be on the dorsal side of the hand receiving portion. A lower forearm portion can be attached to the hand receiving portion.

In another exemplary embodiment, a protective glove can have a hand receiving portion that can include a plurality of finger portions, a thumb portion, a metacarpal portion and a wrist portion. The hand receiving portion can have a dorsal side and a palm side. A plurality of protective elements can be on the dorsal side of the hand receiving portion. At least one vent having a mesh covering can be defined on the dorsal side of the hand receiving portion and can be between two or more protective elements. The at least one mesh-covered vent can expand in size when the protective glove is in a grasping configuration. A lower forearm portion can be attached to the hand receiving portion.

BRIEF DESCRIPTION OF THE FIGURES

Advantages of embodiments of the present invention will be apparent from the following detailed description of the exemplary embodiments thereof, which description should be considered in conjunction with the accompanying drawings in which.

DETAILED DESCRIPTION

Figure 1:
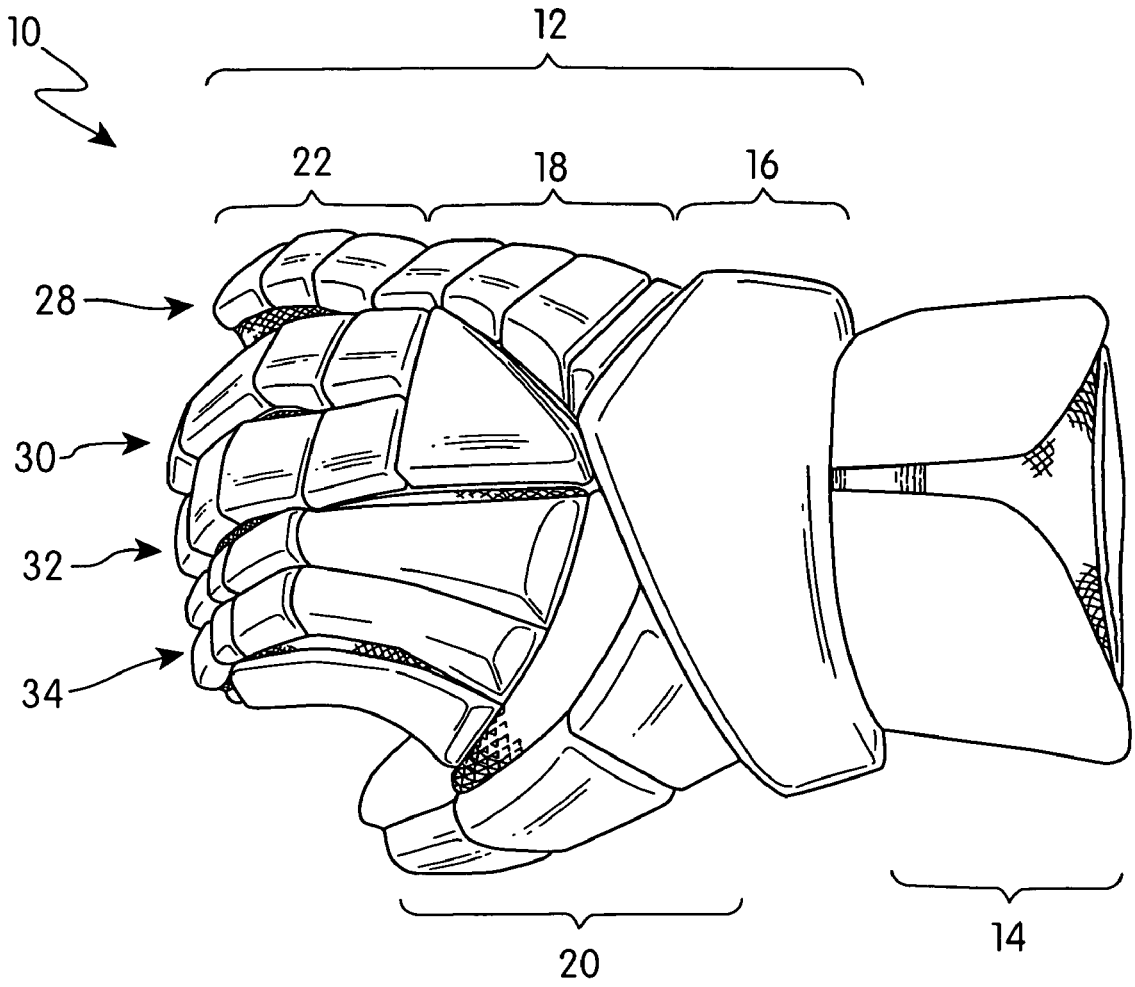
FIGS. 1 and 2 are each a dorsal side perspective view of an exemplary protective glove.

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

The word "exemplary" is used herein to mean "serving as an example, instance, or illustration." Any embodiment described herein as "exemplary" is not necessarily to be construed as preferred or advantageous over other embodiments. Likewise, the term "embodiments of the invention" does not require that all embodiments of the invention include the discussed feature, advantage or mode of operation.

In at least one exemplary embodiment, impact gel pieces and means can be provided on a protective sporting glove, such as a lacrosse glove or hockey glove. Impact gel pieces and means can absorb impact due, at least in part, to compression of the gel resulting from the force of the impact. Impact gel pieces may seem to harden as the gel is compressed due to the impact. Impact gel pieces also may assist in dampening vibration and reducing other stresses to a wearer's hand and surrounding areas. Impact gel pieces can be formulated to have a variety of compression characteristics.

Impact gel means can be provided on any area of the protective sporting glove. Thus, impact gel pieces and means can be provided on the finger portions, thumb portions, metacarpal portion, wrist portion and lower forearm portion of a protective sporting glove.

For example, one or more impact gel pieces can be provided between conventional, sectional padding elements where gaps in protection may otherwise occur on the dorsal side of a protective sporting glove. Moreover, singularly or in conjunction, impact gel pieces can be substituted for conventional, sectional padding elements or can form part of a sectional padding element having impact gel means and conventional padding means.

Exemplary impact gel pieces can be a polyurethane ("PU") gel pieces and the like. Polyurethane gel pieces can be formed substantially from polyurethane polymers by known processes. For example, impact gel pieces can be formed from injection molding processes, such as reaction injection molding ("RIM molding") and the like.

Polyurethane gel pieces formed by, for example, injection molding processes can be produced in a variety of desired softness ratings according to specification (e.g., across the very soft Durometer range). Polyurethane gel pieces can thus be produced according to various specifications that seek to balance flexitibility and impact protection for use on areas of a protective sporting glove.

Impact gel pieces for use with protective sporting gloves can be encapsulated by various material including plastics, elastomers, flexible films, plastic skins, rubbers, synthetic leathers, cloths and the like. Also, an encapsulating material may be textured, for example, on the outside thereof. For instance, an encapsulating material can have a raised surface pattern, such as a diamond-patterned raised surface. Moreover, encapsulating materials can be rough, grainy, scabrous and the like.

An impact gel piece may have a bottom portion made of a hard insert such as a plastic or metal, which also may aid in providing the impact gel piece to a portion of a protective sporting glove. For example, the impact gel piece can be sewn, adhered by an adhesive or otherwise attached to portions of a protective sporting glove. Also, encapsulated impact gel pieces can be further covered by a leather, a synthetic leather, a cloth and the like known to one having ordinary skill in the art when provided on protective sporting gloves. Alternatively, an encapsulated impact gel piece can not be covered.

Notably, polyurethane gel pieces can be produced in various colors useful for executing a variety of aesthetic designs for protective sporting gloves. Polyurethane gel pieces can have various filler materials, color agents and plasticizers added to create unique characteristics.

Figure 2:
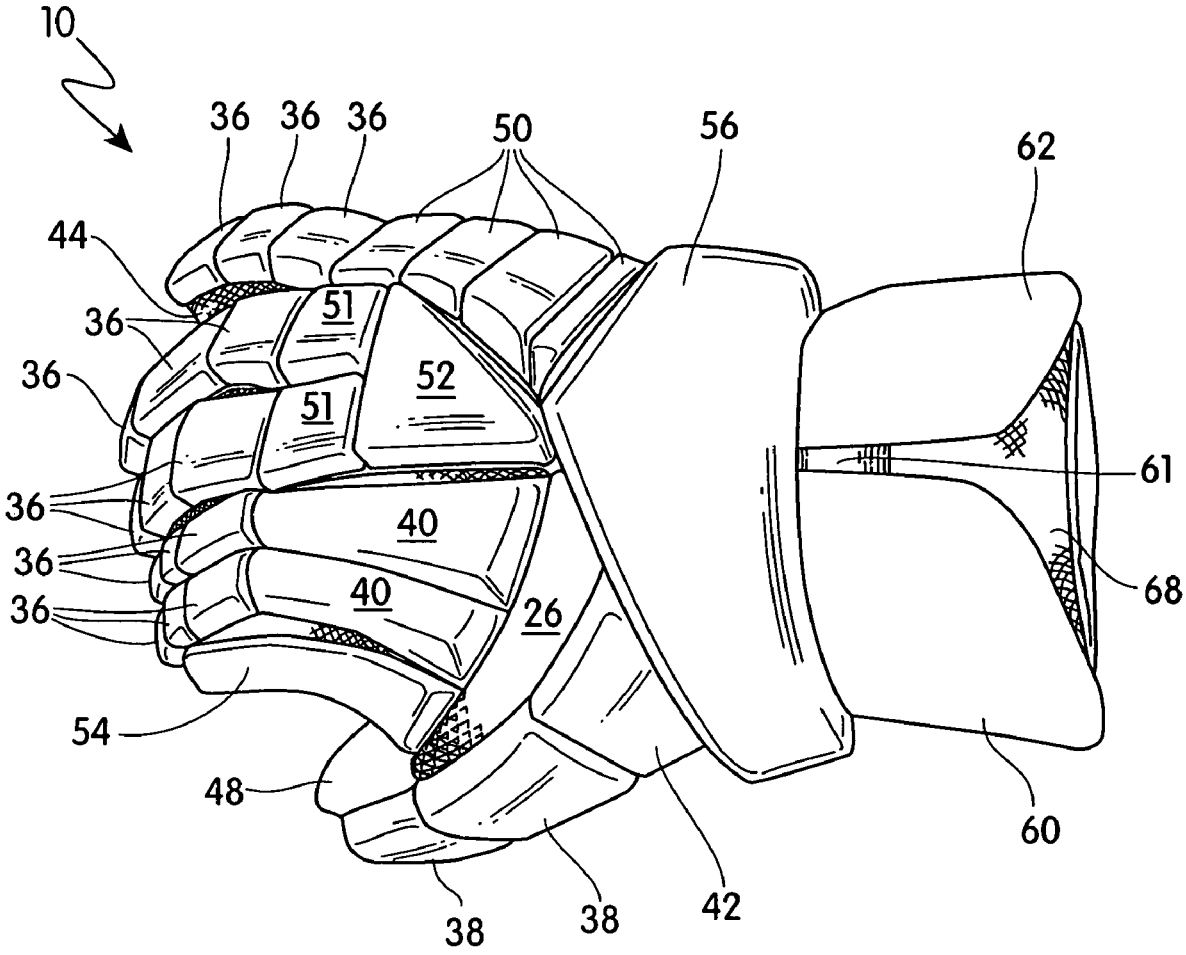
Figure 3:
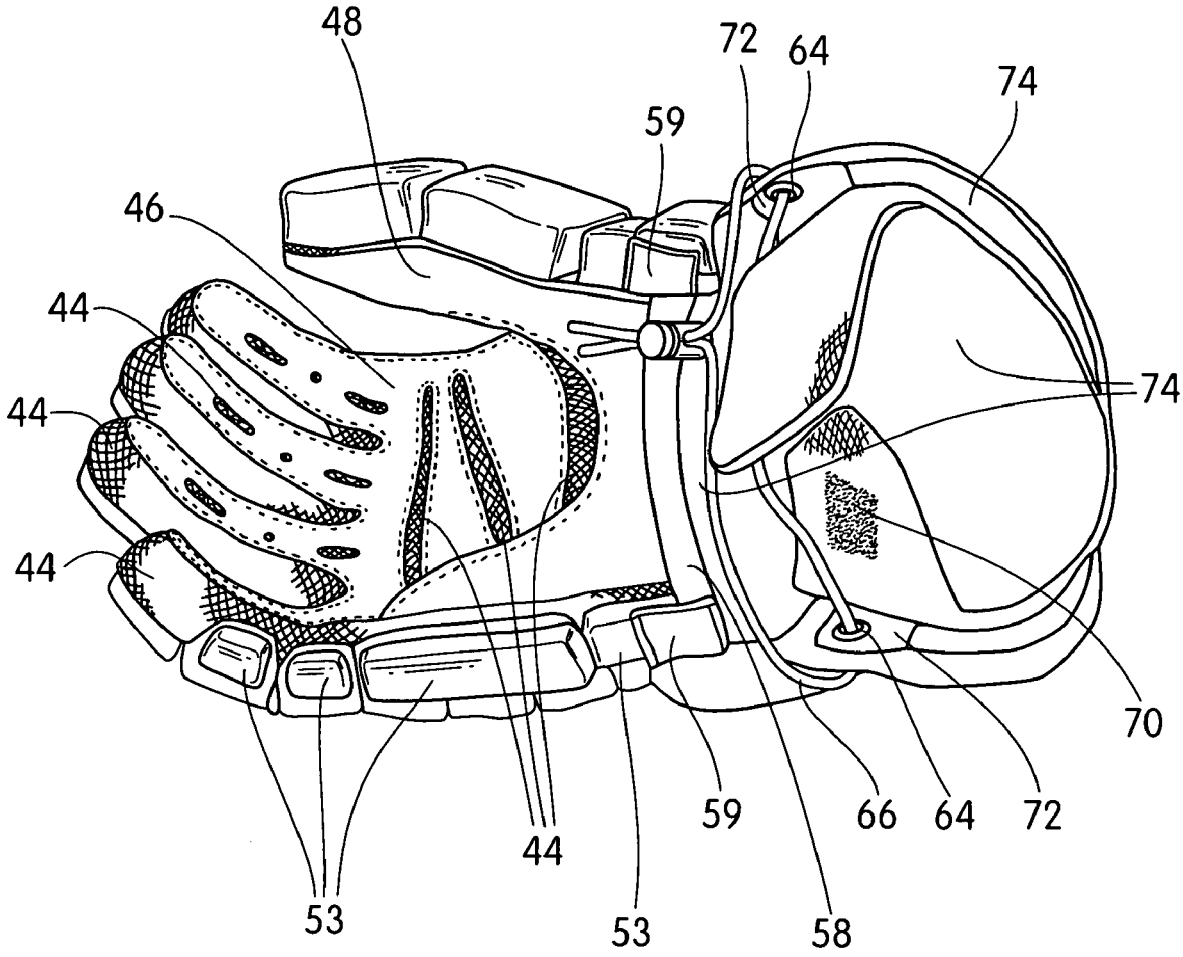
FIG. 3 is a palm side perspective view of an exemplary protective glove.
Figure 4:
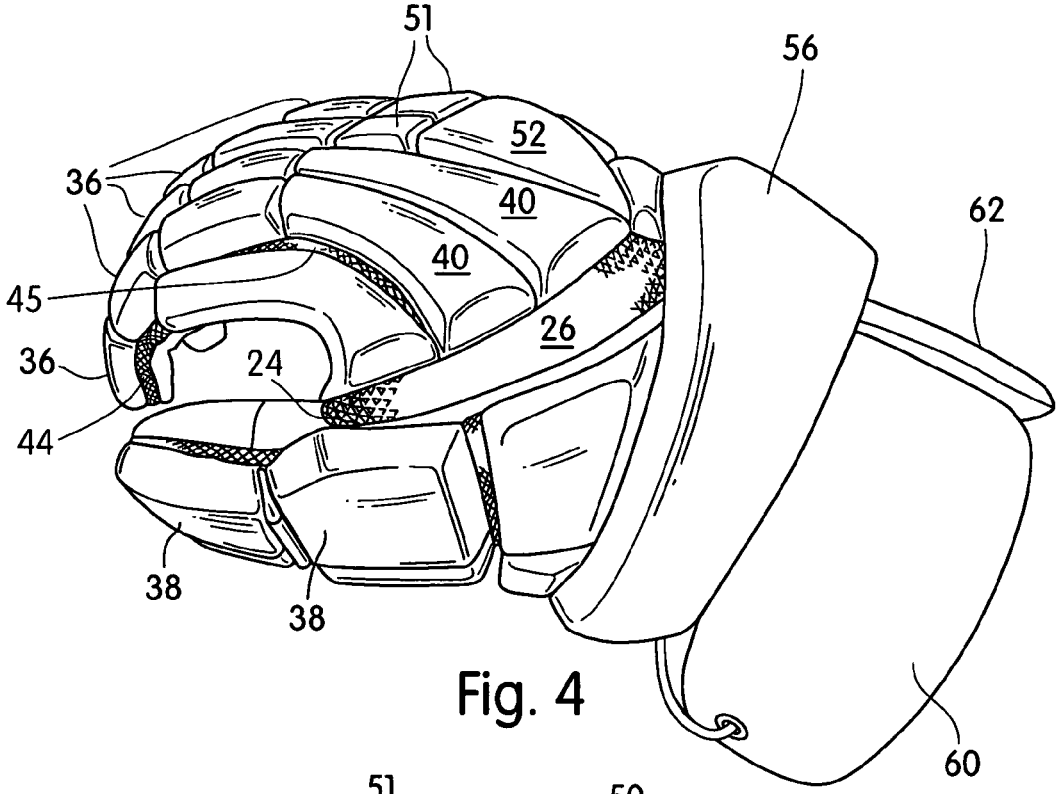
FIG. 4 is a thumb side perspective view of an exemplary protective glove.
Figure 5:
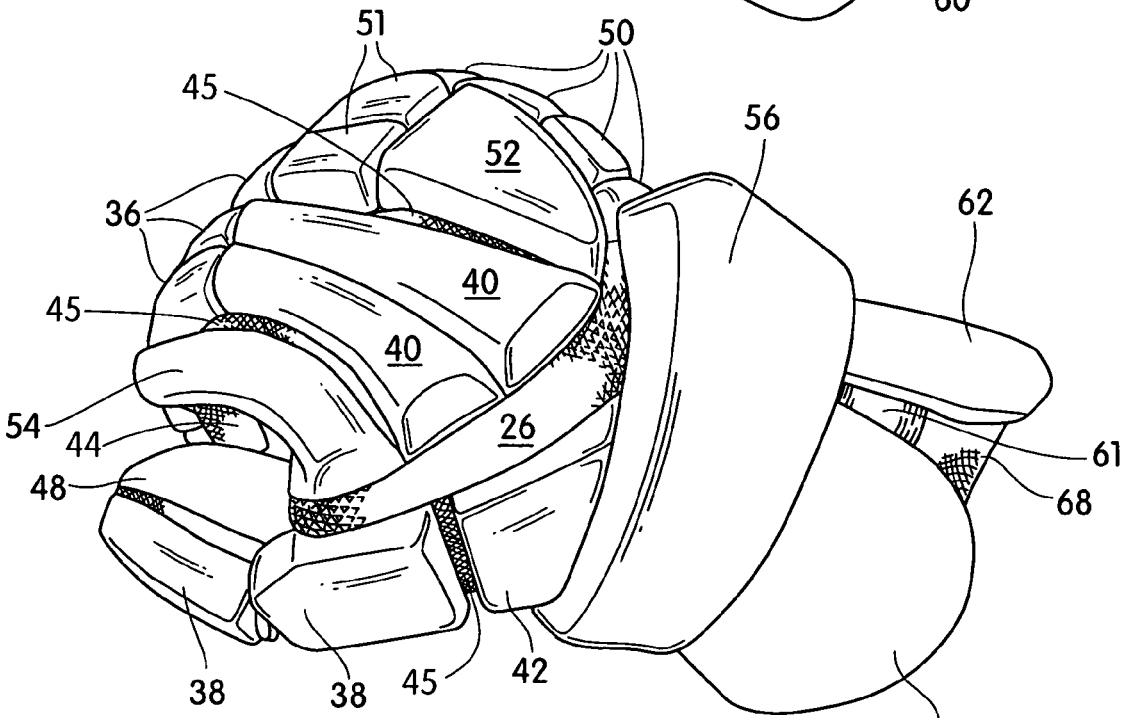
FIG. 5 is a thumb side perspective view of an exemplary protective glove in a grasping configuration.

Referring to FIGS. 1-5, a protective sporting glove in accordance with at least one exemplary embodiment is shown. Protective glove 10 can have hand receiving portion 12 attached to lower forearm portion 14. Hand receiving portion 12 can be attached to lower forearm portion 14 by any of a variety of means known to one having ordinary skill in the art. Alternatively, hand receiving portion 12 can be attached to lower forearm section 14 by an elastomeric connection (not shown) at wrist portion 16. The elastomeric connection may provide increased flexibility to wrist portion 16 of hand receiving portion 12.

Hand receiving portion 12 can include wrist portion 16, metacarpal portion 18, thumb portion 20 and four-finger portion 22. Wrist portion 16, metacarpal portion 18 and thumb portion 20 can all be operatively coupled (e.g., integrally) with one another. Four-finger 22 portion can extend from metacarpal portion 18.

Spanning at least part of hingelike seam 24, impact gel piece 26 can be provided in accordance with at least one exemplary embodiment. Hingelike seam 24 can form one boundary between metacarpal portion 18 and thumb portion 20 (see, e.g., FIG. 4). Impact gel piece 26 can be provided partly or wholly along seam 24. Impact gel piece 26 can provide additional protection to an area of a wearer's hand that may benefit from the ability to be manipulated with less hindrance while adding protection to the same. Particularly, a wearer grasping a stick is expected to expose hingelike seam 24 if not protected. The combined flexibility and protection that can be provided by impact gel piece 26 to this area of protective glove 10 can thus benefit a wearer.

An exemplary impact gel piece 26 can have a polyurethane gel substantially encapsulating by a flexible plastic casing. The exemplary polyurethane gel may be clear or colored. An exemplary plastic casing may have a raised texture, such as a raised diamond-patterned texture. The bottom of the exemplary gel piece 26 can be a thin metallic or plastic material, which may include a smoother center portion. Exemplary impact gel piece 26 can be provided on hand receiving portion by sewing and/or through the use of an adhesive and the like known to one having ordinary skill in the art.

Four-finger portion 22 can include little finger portion 28, ring finger portion 30, middle finger portion 32 and index finger portion 34. Each finger portion of four-finger portion 22 can have three sectional protective elements 36 corresponding to the distal phalange, the intermediate phalange and the proximal phalange of a wearer's finger. As is known to one of ordinary skill in the art, such sectional protection can decrease hindrance to flexion and extension of a wearer's fingers via the interphalangeal joints.

Index finger portion 34 can have three sectional protective elements 36 to provide protection from impact as well as increase finger manipulation. Further index finger portion 34 can have its protective elements 36 bifurcated (thus producing six protective elements) to increase flexibility of protective glove 10 within and around the index finger of a wearer. Sectional protective elements 36 provided on any of little finger portion 28, ring finger portion 30 and middle finger portion 32 can be likewise bifurcated as will be appreciated by one having ordinary skill in the art.

Similarly, thumb portion 20 can include two sectional protective elements 38 corresponding to the distal phalange and proximal phalange of a wearer's thumb. Also likewise, sectional protective elements 38 can be bifurcated.

Referring to metacarpal portion 18, protective elements 40 and 42 can be split so as to match the bifurcation of sectional protective elements 36 and sectional protective elements 38, respectively. Thus, protective element 40 can be aligned with index finger portion 34 and protective element 42 can be aligned with thumb portion 20.

Sectional protective elements 36, 38, 40 and 42 can be made of conventional materials known to one having ordinary skill in the art including foams (e.g., dual density foam, low density memory foam, grid foam etc.), plastics (e.g., thermoplastics), rubbers and the like. As a couple non-limiting examples, protective elements 36, 38, 40 and 42 can use polyethylene inserts and composite inserts for padding. Protective elements 36, 38, 40 and 42 can be covered by a conventional leather, a synthetic leather, a cloth and the like known to one having ordinary skill in the art.

Forming, at least in part, the stalls (i.e. finger and thumb shealths) characteristic of four-finger portion 22 and thumb portion 20 can be mesh 44. Mesh 44 can be any suitable mesh known to one having ordinary skill in the art. Alternatively, a conventional leather, synthetic leather, cloth and the like soft, flexible materials known to one having ordinary skill in the art can be used to form, at least in part, the stalls as well as a palm for protective glove 10.

Mesh 44 can be substantially ubiquitous throughout (i.e. pieces or portions of mesh 44 can be found throughout) hand receiving portion 12. For example, mesh 44 can function as a substrate/attachment face for upper palm piece 46, which can be made of leather, synthetic leather, cloth and like soft, flexible materials known to one having ordinary skill in the art. Moreover, mesh 44 can be an attachment face or provide at least one attachment place for lower palm piece 48. Lower palm piece 48 can also be made of leather, synthetic leather, cloth and like soft, flexible materials known to one having ordinary skill in the art.

On the dorsal side of hand receiving portion 12, mesh 44 can serve as an attachment face or provide at least one attachment place for sectional protective elements 36, 38, 40, 42, 50, 52 and 54, as well as impact gel piece 26 (itself a sectional protective element). Since mesh can serve as a substrate or connector for at least some of the numerous protective elements, mesh-covered vents 45 can be provided on the dorsal side of hand receiving portion 12.

Mesh-covered vents 45 can thus be interspersed between one or more sectional protective elements 36, 38, 40, 42, 50, 52, 54 and impact gel piece 26 (itself a sectional protective element). Mesh-covered vents 45 can increase ventilation and breathability within and throughout protective glove 10. Mesh-covered vents 45 can also expand in size due to movements of protective glove 10 that further separate protective sections such as those movements for grasping and manipulating a lacrosse or hockey stick.

Alternatively, singularly or in conjunction, materials such as leather, synthetic leather, and cloth can be used in whole or in part to connect the plurality of protective elements 36, 38, 40, 42, 50, 52, 54 and impact gel piece 26. Also, as is known by one having ordinary skill in the art, ventilation holes and vents and the like can be provided on dorsal side of hand receiving portion 12 that may not be mesh-covered and/or may substantially retain their shape despite movements of a wearer's hand. Such perforated areas can also provide ventilation and breathability.

On the palm side, exposed mesh 44 can provide numerous ventilation holes to a wearer's hand, particularly, the palm portion thereof. Alternatively, various other types of ventilation holes can be defined on a palm as is known to one having ordinary skill in the art. Upper palm piece 46 and lower palm piece 48, singularly or in conjunction, can provide numerous contact areas for effectively gripping and handling an object such as the shaft of a lacrosse or hockey stick. Also, hem 58 can be provided proximate wrist portion 16 of hand receiving portion and may be formed from an elastomeric material so as to increase flexibility thereat.

On the dorsal side of metacarpal portion 18, sectional protective elements 40, 42, 50, 51, 52 and 54 can be provided. In the center, protective elements 51 can be respectively provided proximate ring finger portion 30 and middle finger portion 32. Substantially triangular protection section 52 can have its base proximate protective elements 51. Although, one having skill in the art can further segment or adopt a non-triangular configuration for protective element 52, the one-piece substantially triangular construction of protective element 52 can provide a balance of flexibility and rigidity to the center of metacarpal portion 18 as will be appreciated by one having ordinary skill in the art.

As stated previously, protective elements 40 and 42 can be split so as to match the bifurcation of sectional protective elements 36 and sectional protective elements 38, respectively. Thus, protective element 40 can be aligned with index finger portion 34 and protective element 42 can be aligned with thumb portion 20. Also, impact gel piece 26 can be provided proximate protective element 40 and protective element 42, among others.

To the little finger side of triangular protective element 52, segmented protective element 50 can be provided on the dorsal side of metacarpal portion 18. As shown, the segments of protective element 50 can run substantially widthwise and may aid in performing twisting and grasping movements with protective glove 10 by a wearer. Also, protective elements 53 can be provided to provide lateral protection to the little finger side of hand receiving portion 12. As shown, protective elements 53 can be sectional (and may be irregular) and may span lateral portions of the four-finger portion 22 and metacarpal portion 18 as well as within wrist portion 16. In general, the lower protective elements of metacarpal portion 18 may extend into wrist portion 16 and may be partly covered by floating cuff 56.

To the far index finger side of metacarpal portion 18, lengthwise protective element 54 can be situated proximate protective element 40. Protective element 40 can be split/bifurcated and the two halves of protective element 40 can also run lengthwise. Lengthwise protective element 54 can also cover or be disposed on part of index finger portion 32. Taken conjunctively, protective elements 40 and 54 can be three lengthwise protective elements on the index finger side of metacarpal portion 18. Impact gel piece 26 can be proximate these lengthwise protective elements. Also, protective elements 40 and 54 can extend beyond (e.g., be thicker than) impact gel piece 26. Protective element 54 may offer protection to a corresponding area of a wearer's hand without significantly decreasing flexibility of the glove within and around the index finger of a wearer.

Wrist/cuff (corpus) portion 16 of hand receiving portion 12 can include a floating cuff 56 on the dorsal side. Floating cuff 56 can be connected to hand receiving portion 12 by elastomeric connectors/bridges 59, which may number two and be proximate the left and right boundaries defining the dorsal and palm sides of hand receiving portion 12. Hidden from view by floating cuff 56, an elastomeric connector can attach hand receiving portion 12 and lower forearm section 14 as stated above. Floating cuff 56, which can be considered another protective element, can be beveled. Beveling float cuff 56 may prevent or decrease interference with movements (e.g., flexion and extension) of a wearer's wrist and surrounding areas of the hand and forearm.

Like sectional protective elements 36, 38, 40 and 42, sectional protective elements 50, 51, 52, 53, 54 and 56 can be made of conventional materials known to one having ordinary skill in the art including foams (e.g., dual density foam, low density memory foam, grid foam, etc.), plastics (e.g., thermoplastics), rubbers and the like. As a couple non-limiting examples, protective elements 50, 51, 52, 53, 54 and 56 can use polyethylene inserts and composite inserts for padding. Protective elements 50, 51, 52, 53, 54 and 56 can be covered by a leather, a synthetic leather, a cloth and the like known to one having ordinary skill in the art.

Lower forearm portion 14 can provide a degree of protection to the lower forearm of a wearer located just above the wrist to less than halfway the distance to a wearer's elbow. Lower forearm portion 14 can include shell pieces 60 and 62 that may provide protection to the dorsal side of a wearer's lower forearm. Shell pieces 60 and 62 can be connected by elastomeric connector/bridge 61. The split configuration of shell pieces 60 and 62 increases flexibility of protective glove 10, particularly, between lower forearm portion 14 and wrist portion 16 of hand receiving portion 12. Shell piece 60 can be greater in area. Shell piece 60 may also extend further up a wearer's forearm than shell section 62.

Each shell piece 60 and 62 can include eyelet 64 for passage of tie 66. Alternatively, other fastening systems such as hook-and-loop systems, elastomeric connector systems and the like known to one of ordinary skill in the art can be used.

Lower forearm section 14 can also include forearm contacting sleeve/piece 68, which may be fastenable so as to substantially encircle a wearer's lower forearm. For example, a hook-and-loop fastening system, a tie system, an elastomeric connector system and the like fastening system known to one having ordinary skill in the art can be used. As shown, a hook-and-loop fastening system 70 can bring the opposite of ends of forearm contacting piece together.

Forearm contacting piece 68 can reside inside shell pieces 60 and 62. Forearm contacting piece 68 can also be less heavily padded as compared to shell pieces 60 and 62 and may be somewhat more flexible. For example, forearm contacting piece 68 can have grid foam padding with an outer covering. The outer covering can be a mesh such as an open athletic mesh and the like. Forearm contacting piece 68 can be attached to shell pieces 60 and 62 via first and second elastomeric connectors 72, respectively. Alternatively, singularly or in conjunction, forearm contacting piece 68 can be attached to hand receiving portion 12. Although, if forearm contacting piece 68 is singularly connected to shell pieces 60 and 62, an increase in the range of motion of forearm contacting piece 68 can be achieved and thus may benefit a wearer by offering an increase in freedoms of movement.

Like sectional protective elements 36, 38, 40, 42, 50, 52, 54, and 56, sectional protective elements 60, 62 and 68 can be made of conventional materials known to one having ordinary skill in the art including foams (e.g., dual density foam, low density memory foam, grid foam, etc.), plastics (e.g., thermoplastics), rubbers and the like. As a couple non-limiting examples, protective elements 60, 62 and 68 can use polyethylene inserts and composite inserts for padding. Protective elements 60, 62 and 68 can be covered by a leather, a synthetic leather, a cloth and the like known to one having ordinary skill in the art.

In general, liner 74 can line various inner areas of protective glove 10. For example, liner 74 can line substantially all of the inner dorsal side of hand receiving portion 12 (i.e. the inside of protective glove 10 contacting the back of a wearer's hand). Also, liner 74 can line the inner side of shell pieces 60 and 62, as well as the inner side of forearm contacting piece 68 of lower forearm portion 14. Liner 74 can be padded with grid foam as one non-limiting example. Other suitable liner padding types are known to one having ordinary skill in the art. Liner 74 can have an antibacterial coating applied thereto.

Liner 74 can include vents or holes defined therein that may or may not be mesh-covered. Any vents or holes defined in liner 74 may correspond to mesh-covered vents 45 formed on the outer dorsal side of hand receiving portion 12. Thus, substantially aligned vents or holes on the inner and outer dorsal sides of hand receiving portion 12 can provide ventilation channels to the back of a wearer's hand. Alternatively, mesh-covered vents 45 may be provided on the outer dorsal side of hand receiving portion 12 without corresponding vents or holes being defined through liner 74. This configuration may still provide a suitable degree of breathability to a wearer's hand.

The foregoing description and accompanying drawings illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A protective glove comprising:

a hand receiving portion including a plurality of finger portions, a thumb portion, a metacarpal portion and a wrist portion, the hand receiving portion having a dorsal side and a palm side;

a liner which lines at least an inner dorsal side of the hand receiving portion;

a plurality of protective elements including non-gel protective sections and at least one impact gel piece, the plurality of protective elements on the dorsal side of the hand receiving portion, the impact gel piece including a polyurethane gel that is encapsulated by an encapsulating material that is made of at least one of a plastic, a plastic skin and a flexible film, the impact gel piece including a bottom portion that is formed of a plastic insert or a metal insert, the bottom portion being harder than the encapsulating material; and a lower forearm portion attached to the hand receiving portion.

2. The protective glove of claim 1, wherein an impact gel piece is positioned between two or more non-gel protective sections.

3. The protective glove of claim 2, wherein the liner has an antibacterial coating.

4. The protective glove of claim 1, wherein an impact gel piece is proximate the thumb portion.

5. The protective glove of claim 1, wherein the at least one impact gel piece is substantially formed from polyurethane.

6. The protective glove of claim 1, wherein the at least one impact gel piece is formed by an injection molding process.

7. The protective glove of claim 1, wherein one or more vents are formed on the dorsal side of the hand receiving portion, the one or more vents having a mesh covering.

8. The protective glove of claim 7, wherein one or more vents are formed on the dorsal side of the hand receiving portion but are not defined through the liner, the one or more vents having a mesh covering.

9. The protective glove of claim 1, wherein at least one of the plurality of finger portions or the thumb portion, inclusive, has bifurcated non-gel protective sections.

10. The protective glove of claim 1, wherein the palm side of the hand receiving portion includes a palm, the palm having mesh sections and non-mesh sections.

11. The protective glove of claim 1, wherein the wrist portion includes a floating cuff.

12. The protective glove of claim 11, wherein the floating cuff is beveled.

13. The protective glove of claim 1, wherein the lower forearm portion is sectional.

14. The protective glove of claim 1, wherein the plurality of finger portions are formed, at least in part, by one or more mesh sections.

15. The protective glove of claim 1, wherein the non-gel protective sections are covered with one of a leather, a synthetic leather and a cloth.

16. The protective glove of claim 1, wherein the non-gel protective sections have padding made of at least one of a foam, a plastic and a rubber.

17. The protective glove of claim 1, wherein the non-gel protective sections have a padding, the padding being at least one of a dual density foam padding, a low density memory foam padding, a grid foam padding, a polyethylene insert padding and a composite insert padding.

18. A protective glove comprising:

a hand receiving portion including a plurality of finger portions, a thumb portion, a metacarpal portion and a wrist portion, the hand receiving portion having a dorsal side and a palm side;

a liner which lines at least an inner dorsal side of the hand receiving portion;

a plurality of protective elements on the dorsal side of the hand receiving portion, the plurality of protective elements including at least one impact gel piece, the impact gel piece including a polyurethane gel that is encapsulated by an encapsulating material that is made of at least one of a plastic, a plastic skin and a flexible film, the impact gel piece including a bottom portion that is formed of a plastic insert or a metal insert, the bottom portion being harder than the encapsulating material;

at least one vent having a mesh covering defined on the dorsal side of the hand receiving portion, the at least one mesh-covered vent between two or more protective elements, wherein the at least one mesh-covered vent expands in size when the protective glove is in a grasping configuration; and a lower forearm portion attached to the hand receiving portion.

* * * * *